United States Patent [19]

Sage et al.

[11] Patent Number: 5,007,552

[45] Date of Patent: Apr. 16, 1991

[54] SERVING BAR AND CONTAINER FOR FOOD

[75] Inventors: Daniel E. Sage, Dayton; James C. Patrick, Jr., Troy, both of Ohio

[73] Assignee: Ponderosa Corporation, Dayton, Ohio

[21] Appl. No.: 131,567

[22] Filed: Dec. 11, 1987

[51] Int. Cl.[5] ..... A47F 5/00

[52] U.S. Cl. ..... 220/23.83; 220/23.4

[58] Field of Search ..... 220/23.83, 23.40, 23.86, 220/85 H

[56] References Cited

U.S. PATENT DOCUMENTS

| | | | |
|---|---|---|---|
| 1,349,527 | 8/1920 | Owen | 220/20 X |
| 1,802,426 | 4/1931 | Hoyt | 220/1 C |
| 2,357,048 | 8/1944 | Jackson | 220/23.83 X |
| 2,539,326 | 1/1951 | Quitter | 220/23.4 X |
| 3,008,788 | 11/1961 | Garner | 312/309 |
| 3,608,770 | 9/1971 | Naimoli | 220/23.4 X |
| 3,628,807 | 12/1971 | Fullington et al. | 280/79.3 |
| 3,917,106 | 11/1975 | Bargetzi | 220/23.83 |
| 4,107,815 | 8/1978 | Dumesnil, Jr. | 15/257.05 |
| 4,131,203 | 12/1978 | Bridges | 211/88 |
| 4,454,949 | 6/1984 | Flum | 211/49 D |
| 4,481,907 | 11/1984 | Blicher | 119/51 R |
| 4,550,837 | 11/1985 | Simmons | 211/126 |

*Primary Examiner*—Steven M. Pollard

*Attorney, Agent, or Firm*—Killworth, Gottman, Hagan & Schaeff

[57] ABSTRACT

A container for food which comprises a pan having a bottom and two sets of opposing side walls extending therefrom to an opening and defining a compartment for for holding the food is disclosed. The container also comprises a first cover engageable with periphery of one end of the pan adjacent the opening for covering a portion of the opening adjacent that end, whereby a fixed quantity of food is exposed by the remaining portion of the opening. Additionally, the side walls of one of the sets of side walls tapers in height, as measured between the bottom and the opening, to define the compartment as having a first portion of larger volume at one end of the pan than a second portion having a smaller volume at the other end of the pan. The first cover is adaptable to enclose either the first portion of the compartment, whereby a smaller quantity of food is exposed in the second portion of the compartment, or the second portion of the compartment, whereby a larger quantity of food is exposed in the first portion of the compartment. A serving bar comprising a base having a substantially rectangular shaped opening, the periphery of which forms a substantially rectangular shaped upper edge for supporting such containers, is also disclosed.

11 Claims, 4 Drawing Sheets

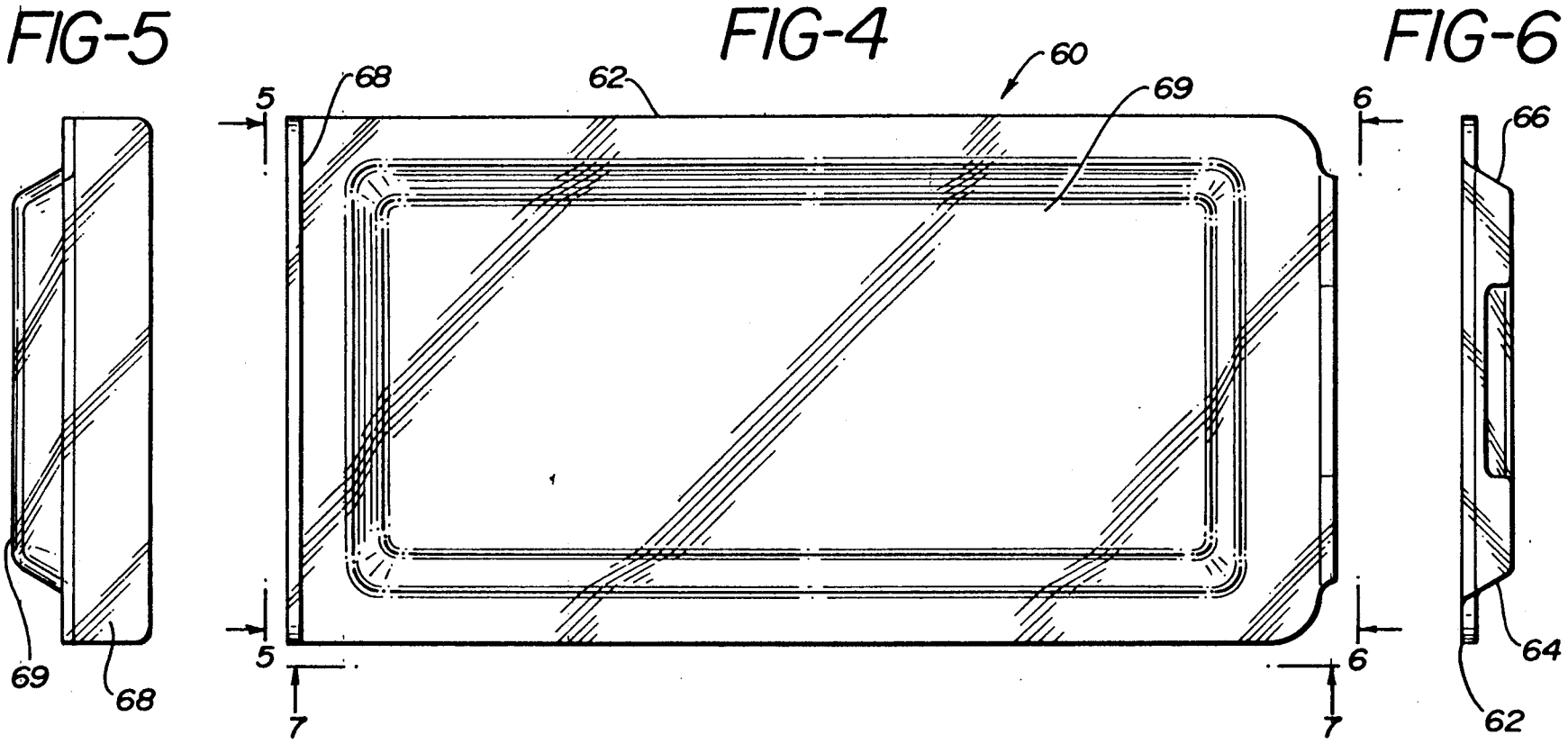
FIG-6
66
64
62
6
6
7
FIG-4
69
60
62
68
7
5
5
FIG-5
68
69
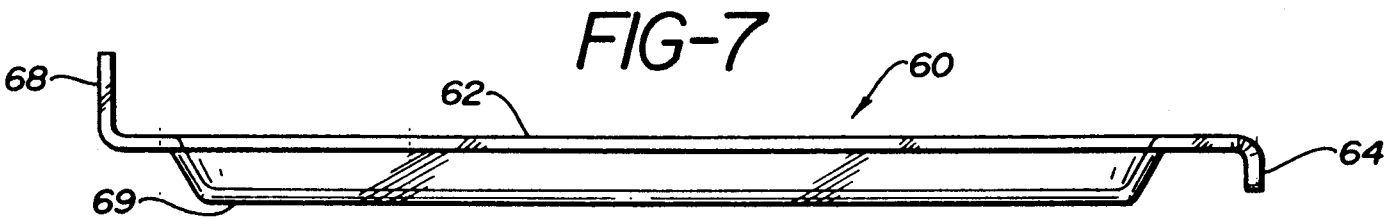
FIG-7
64
60
62
69
68

SERVING BAR AND CONTAINER FOR FOOD

BACKGROUND OF THE INVENTION

The present invention relates to a food serving bar and, more particularly, to a container seated therein for displaying and dispensing food.

In the restaurant business, a customer reviews a menu and orders food that is prepared in a kitchen and served to the customer who is either seated in a dining area or standing in a line waiting for the food. For several years now, however, food serving bars such as for example, salad bars, have been used to allow the customer to view the food, and then make a selection and serve himself. The problem with this arrangement is that the food is exposed while being displayed in an area that is not readily accessible to the kitchen. More specifically, as customers serve themselves the pans of food become partially emptied some more or less than others. If the partially emptied, portion of the pan is replaced with fresh food, the remaining portion of food still sitting in the pan may be more dried out and is certainly less attractive. In any event, customers will see the food being replaced and, quite naturally, will serve themselves from the fresh food which eventually makes the remaining food even less desirable. Therefore, it becomes necessary to remove the entire pan when only partially empty to properly refill it back in the kitchen. To make the procedure more complicated, some food products are consumed more quickly than others, and consumption of food products may also vary substantially during the day. It is desirable to present the appearance of a well stocked salad bar without allowing large quantities of food to sit out in an unrefrigerated environment. Thus, a substantial amount of labor is required to rotate the food in a staggered fashion so that the food remains fresh and attractively displayed.

A food serving bar typically comprises a base which supports several containers varying in size and shape to properly hold and display different types of good. Since the containers vary in size and shape, each one is seated on a flat bottom in the base through openings having the same shape. The fixed structure of the base and the arrangement of containers in the base create yet another problem. As the demand for different foods changes, it becomes necessary to serve different types of food or the same food in different quantities. For example, a container for serving bean sprouts or a bean salad is smaller than a container for serving lettuce which is bulkier. If another large container is needed to serve more lettuce, the serving bar is not readily adaptable because the fixed structure of the base and openings limits service to a fixed number of containers of fixed size and shape.

Accordingly, there is a need for a serving bar capable of supporting a varying number of containers having different sizes constructed to insure that the food remains fresh and attractively displayed.

SUMMARY OF THE INVENTION

The present invention meets these needs by providing a container for food which comprises a pan having a bottom and two sets of opposing sidewalls extending therefrom to an opening and defining a compartment for holding the food. The container also comprises a first cover engageable with the periphery of one end of the pan adjacent the opening for covering a portion of the opening adjacent that end, whereby a fixed quantity of food is exposed by the retaining portion of the opening Furthermore, the sidewalls of one of the sets of sidewalls tapers in height, as measured between the bottom and the opening, to define the compartment as having a first portion of larger volume at one end of the pan than a second portion having a smaller volume at the other end of the pan. The first cover is adaptable to enclose either the first portion of the compartment, whereby a smaller quantity of food is exposed in the second portion of the compartment, or the second portion of the compartment, whereby a larger quantity of food is exposed in the first portion of the compartment. The container further comprises a second cover engageable with the periphery of the other end of the pan adjacent the opening and cooperating with the first cover to enclose the remaining portion of the opening adjacent the other end of the pan, whereby the food in the compartment is completely covered. The first and second covers are sufficiently flat so that a similar container is stackable thereon.

The present invention also meets these needs by providing a serving bar for supporting the containers of food and comprising a base having a substantially rectangular shaped opening, the periphery of which forms a substantially rectangular shaped upper edge, wherein a first pair of opposing edges are spaced apart by a fixed base length. The serving bar further comprises a plurality of containers, each comprising a pan having a bottom, a first and second set of opposing sidewalls extending therefrom to an opening and defining a compartment for holding the food, and lips extending outwardly from the sidewalls of the first set and engaging a second pair of opposing edges of the base. The sidewalls of the second set of each container are spaced apart by a distance defined as a pan-width, the sum of all the pan-widths being substantially equal to the fixed base length, whereby the containers are continuously seated in the opening of the base. The serving bar is further defined by an integral width which is equal to the fixed base length divided by a maximum number of containers that can comprise the plurality. The plurality of containers comprises an actual number of containers that is less than or equal to the maximum number and the pan-width of each container is equal to an integral multiple of the integral width, whereby containers of different sizes can be contiguously seated in the opening of the base.

Accordingly, it is an object of the present invention to provide a container in which a fixed quantity of food is exposed while a varying quantity is enclosed; to provide a container in which the pan has a smaller volume at one end and a larger volume at the other end so that one or the other can be exposed; and, to provide a serving bar in which containers of different widths can be contiguously seated in the opening of the base of the bar.

Other objects and advantages of the invention will be apparent from the following description, the accompanying drawings and the appended claims.

BRIEF DESCRIPTION OF THE DRAWINGS

FIG. 4 is a plan view of a cover for a pan constructed according to the present invention.

FIG. 5 is an end view taken along the line 5—5 in FIG. 4.

FIG. 6 is an end view taken along the line 6—6 in FIG. 4.

FIG. 7 is a side view taken along the line 7—7 in FIG. 4.

DETAILED DESCRIPTION OF THE PREFERRED EMBODIMENTS

Figure 1:
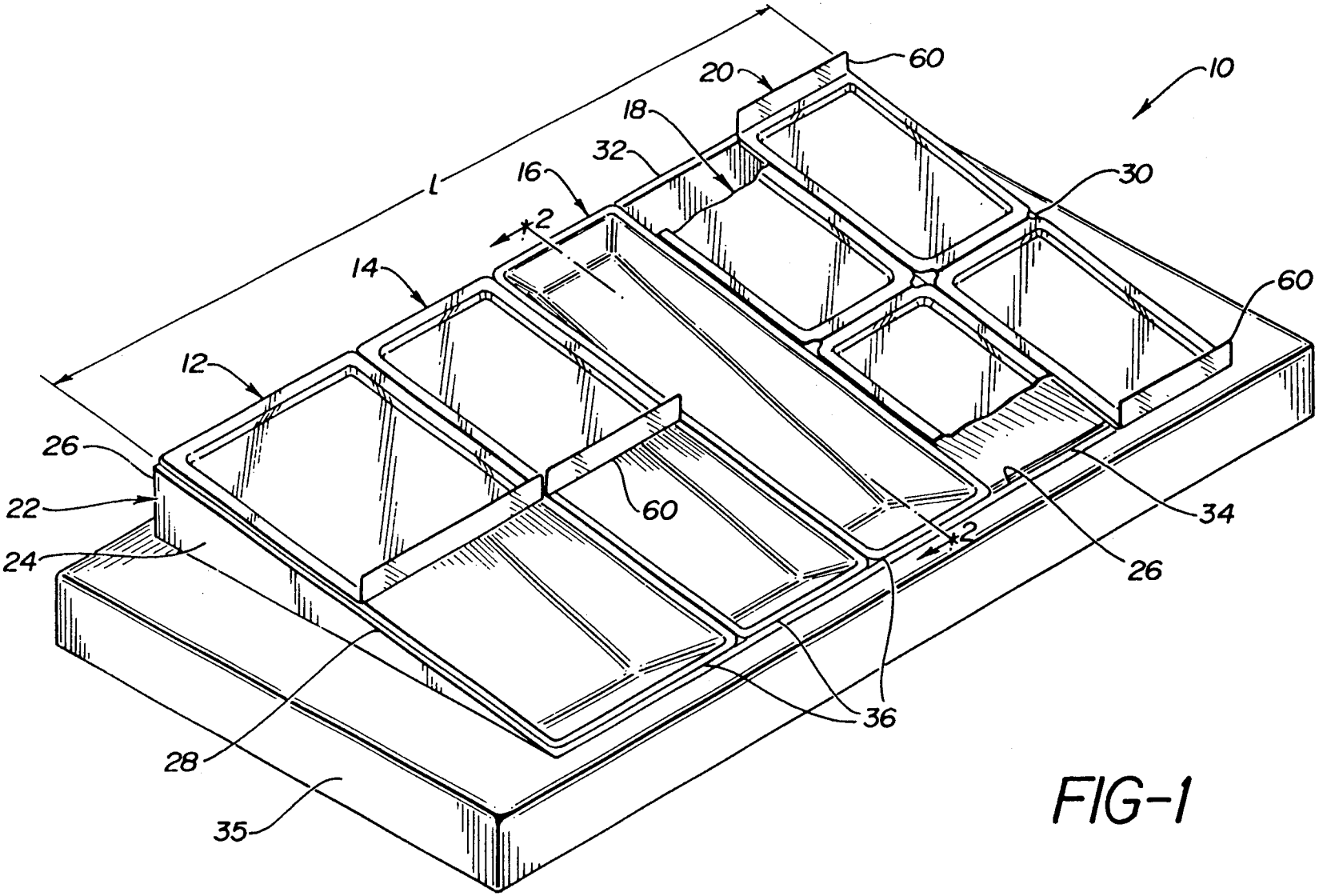
FIG. 1 is a perspective view of a serving bar constructed according to the present invention.

FIG. 1 illustrates a serving bar 10 for supporting containers of food indicated generally at 12,14,16,18 and 20. The serving bar 10 further comprises a base 22 which has a first set 24 of opposing sidewalls (one not shown), both of which taper in height from one end to the other. The distance between the opposing sidewalls of the first set 24 is defined as the fixed base length ("l"). The base 22 has a second set 26 of opposing sidewalls (one not shown), one sidewall of which extends between the shorter ends of the first set 24 of opposing sidewalls and the other extending between the taller ends of the first set 24 of opposing sidewalls.

The sidewalls of the base 22 are substantially perpendicular to each other so that the base 22 has a substantially rectangular-shaped opening, the periphery of which is bounded by the four upper edges 28, 30, 32 and 35 of the sidewalls of the base 22 which form a substantially rectangular-shaped upper edge. The base 22 is seated on a table 34 so that the lower edges of the first and second sets 24, 26 of the sidewalls of the base 22 are seated on the periphery of an opening (not shown) of the table 35.

All of the containers 12,14, 16,18 and 20 are constructed to have a similar structure described as follows. Referring more specifically to the opened container 16 shown in FIG. 1 and even more specifically to FIGS. 2 and 3, the container 16 comprises a pan indicated generally at 36 having a bottom 38, a first set of opposing sidewalls 40,42 and a second set of opposing sidewalls 44,46 extending from the bottom 38 to an opening indicated generally at 48 and defining a compartment 50 for holding the food. A lip 52 extends outwardly from the sidewalls 40,42,44 and 46. The portions of the lip 52 extending from the first set of sidewalls 40,42 engage the upper edges 32,34 of the base 22 which supports the pan 36. The taller upper edge 32 elevates one end of the pan 36 which latches onto the upper edge 32, while the bottom 38 of the pan 36 extends through the opening and the table 35. The second set of sidewalls 44, 46 of the pan 36 taper in height, between the bottom 38 and the opening 48 ("h"), to further define the compartment 50 as having a first portion 54 of larger volume at one end of the pan 36 adjacent the side wall 40 than a second portion 56 having a smaller volume at the other end of the pan 36 adjacent the side wall 42. The second set of sidewalls 44,46 are spaced apart by a distance defined as a pan-width ("w"). The sum of the pan widths, w, of all of the containers 12,14,16,18 and 20 is substantially equal to the fixed base length, l, whereby, the containers 12,14,16,18 and 20 are continuously seated in the opening of the base 22.

Figure 8:
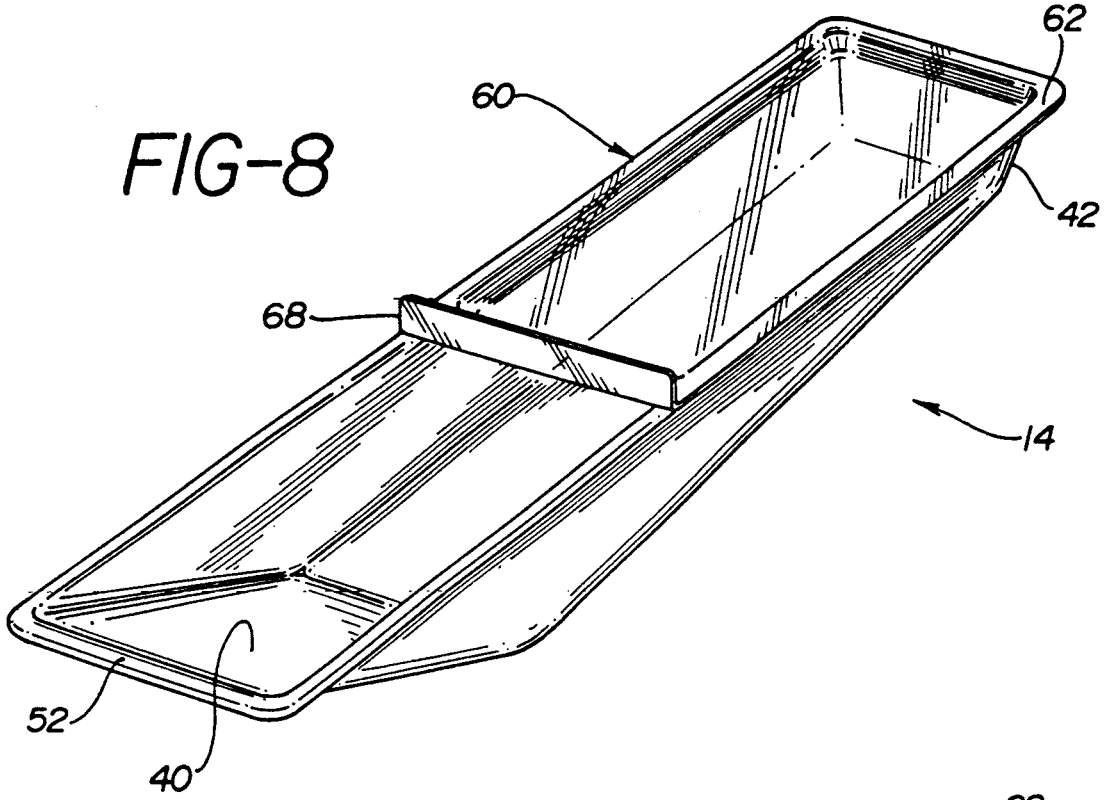
FIG. 8 is perspective view of a container having a first cover constructed according to the present invention.

Each container, e.g., the container 14 in FIG. 1, also comprises a first cover 60. Referring more specifically to FIGS. 4,5,6 and 7. The first cover 60 comprises a body 62, a pair of flanges 64,66 extending generally perpendicularly from one end of the body 62, and a ledge 68 extending generally perpendicularly from the other end of the body 62 in a direction opposite to that of the flanges 64, 66. A recess portion 69 is formed in the body 62 of the first cover 60. Referring to FIG. 8, the body 62 of the first cover 60 is engageable with the periphery of one end of the pan 36 and the flanges 64,66 can latch onto either the portion of the lip 52 extending from the side wall 42 (as shown) or the portion of the lip 52 extending from the side wall 40 (not shown). Typically, the flanges 64, 66 latch onto the end of the pan 36 that is elevated by the upper edge 32 of the base 22.

When the cover 60 is placed on the pan 36 filled with food, it closes the elevated portion of the opening 48 whereby only a fixed quantity of food is exposed in the remaining portion of the opening 48. As the food is being dispensed from the lower portion of the pan 36, the food in the upper portion remains covered and stays fresh. A decorative covering such as fresh lettuce leaves can be placed on the cover 60 to make the display more attractive. The lettuce is held in place by the ledge 68 of the cover 60 and more attractively conceals the supply of food in the upper portion of the pan 36. After the food is partially dispensed from the lower portion of the pan 36, it is replenished by merely lifting the flanged end of the cover 60 and pushing the fresh contents of the upper portion of the pan 36 down into the lower portion of the pan 36 and refilling the upper portion as necessary. Thus, a fresh and attractive supply of food is always available to the lower portion of the pan 36.

The pan 36 can also be rotated 180° so that either the portion of lower volume 56 or the portion of higher volume 54 of the compartment 50 can be situated at the lower end. This structure is clearly adaptable to a varying demand for different types of food because either the low volume compartment 56 or the high volume compartment 54 can be exposed at the lower end of the pan 36, while the cover 60 closes the upper end of the pan 36. This arrangement ensures that the food is kept fresh and attractive for the customer. Furthermore, the customer cannot tell by looking at the food in the lower portion which foods are high volume or low volume because the size of the opening is the same in both cases while the depth is variable, and because the total amount dispensed is concealed by the cover 60 as the food in the lower portion is replenished by forcing the food down from the upper portion.

Figure 9:
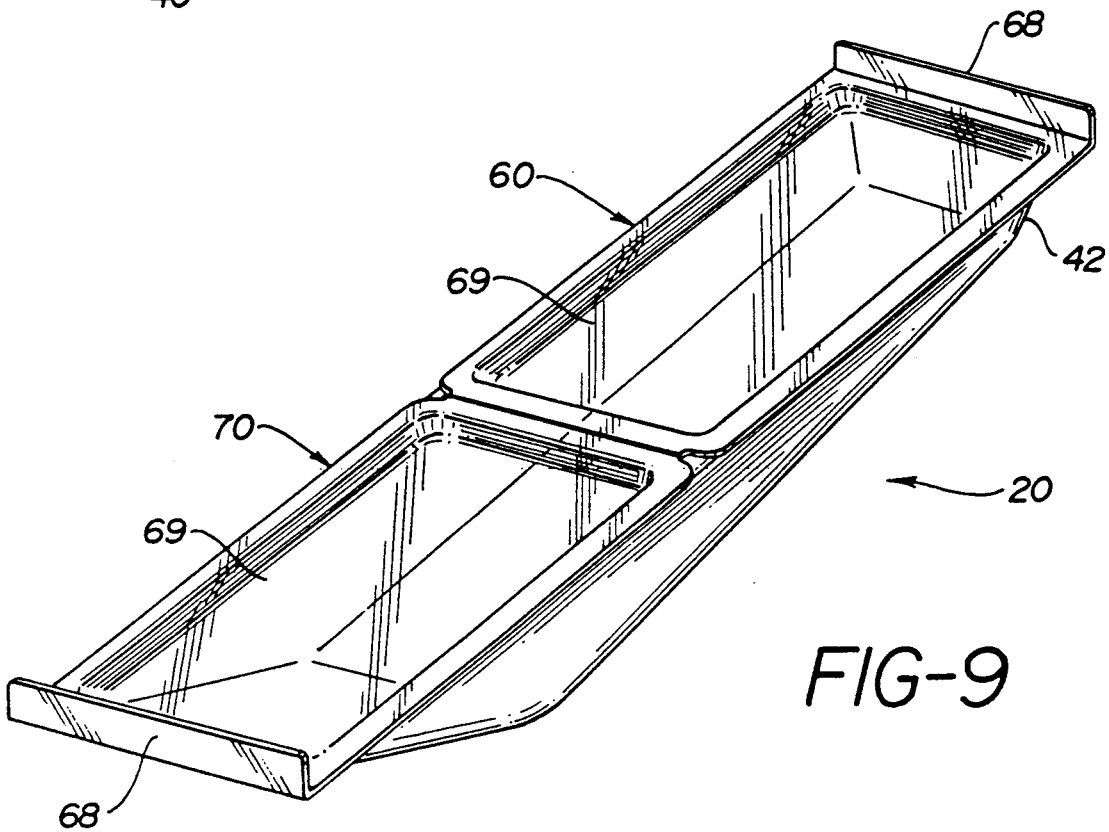
FIG. 9 is perspective view of a container having first and second covers constructed according to the present invention.

When the pan 36 must be removed from the serving bar 10 to be refilled in the kitchen, the first cover 60 is rotated 180° as shown in FIG. 9 so that the ledge 68 extends upwardly from the portion of the lip 52 extending from the sidewall 42 and the flanges 64,66 extend into the compartment 50 of the pan 36. A second cover 70 having the same structure as the first cover 60 is positioned at the other end of the pan 36 in a similar fashion so that the flanges 64,66 (not shown) thereof are contiguous with the flanges 64,66 (not shown) of the first cover 60. The recesses 69 in the bodies 62 of the covers 60, 70 fit snuggly within the periphery of the lip 52 of the pan 36. Since the ledges 68 are positioned at the ends of the pan 36 so that the surface of the container 20 is substantially flat, a container of similar structure can be stacked thereon. Being able to stack several containers reduces the number of refilling trips between the serving bar 10 and the kitchen. If it becomes desirable to cover all of the food without removing the pan 36, the second cover 70 can simply be placed on the lower portion of the pan 36 to cover the opening shown in FIG. 8 so that the ledges 68 of both covers 60, 70 are contiguous.

Sometimes, however, it becomes necessary to serve a more bulky food, such as for example, lettuce which may not fit in the larger volume portion 54 of the compartment 50. The serving bar 10 in this particular case has been designed to accommodate a maximum number of six containers having equal pan-widths, w, although only five are shown. An integral width is defined as the fixed base length, l, divided by this maximum number of containers. Thus, if six containers are positioned in the base 22 of the serving bar 10 and the pan-width, w, of each container is equal to the integral width, all six containers would be contiguously seated in the opening 48 of the base 22.

Because of this arrangement, a container 12 in FIG. 1 having a pan-width, w, equal to twice the integral width, has been substituted for two containers, each having a pan-width, w, equal to the integral width, while all the containers 12,14,16,18 and 20 remain continuously seated in the opening 48 of the base 22. Thus, containers of different sizes are capable of holding bulkier foods that can be contiguously seated in the opening 48 of the base 22, as long as the pan-width, w, of each container is equal to an integral multiple of the integral width. Thus, the serving bar 10 can support a large container to hold a bulkier food like lettuce rather than two smaller containers holding less bulky foods and, therefore, obviates the problems related to a serving bar structure having a fixed opening for each container.

Figure 2:
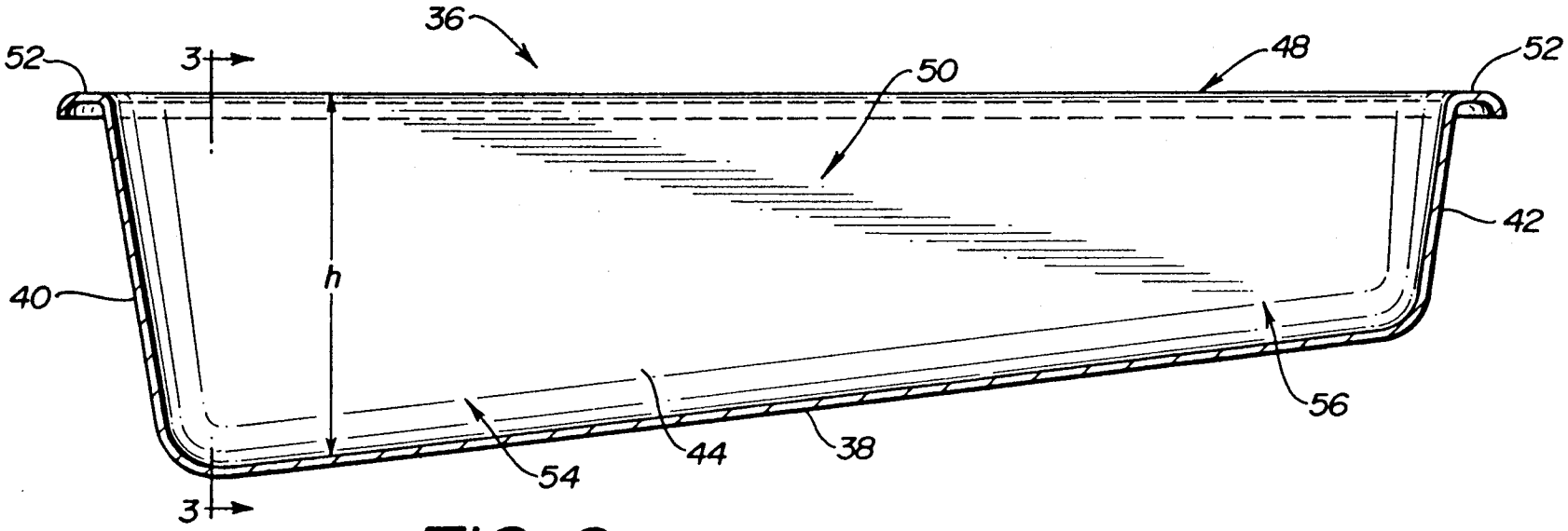
FIG. 2 is an enlarged sectional side view taken generally along the line 2—2 in FIG. 1.
Figure 3:
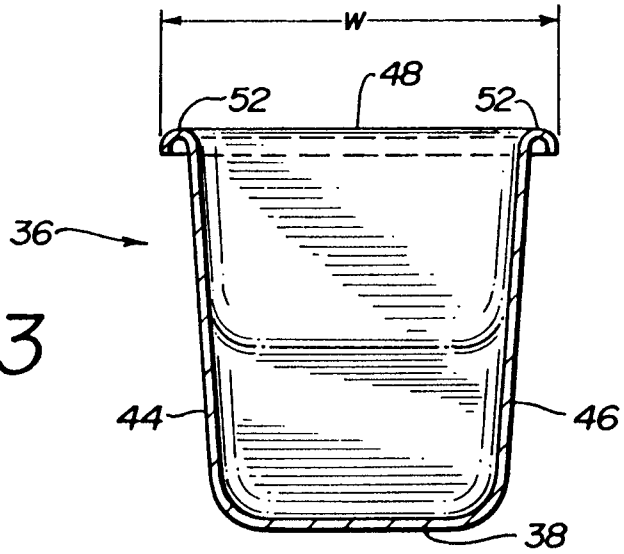
FIG. 3 is a sectional end view taken generally along the line 3—3 in FIG. 2.

Having described the invention in detail and by reference to a preferred embodiment thereof, it will be apparent that other modifications and variations are possible without departing from the scope of the invention defined in the appending claims. For example, the pan itself can have many different shapes such as that shown in FIGS. 2 and 3 compared to FIGS. 8 and 9, as long as one portion of the pan's compartment has a larger volume than the other portion.

What is claimed is:

1. A container for food adapted for being seated, with similar containers, in a serving bar having a substantially rectangular opening for receiving said containers and a substantially rectangular upper edge at the periphery of the opening, opposing edges of said upper edge supporting said container and one edge being higher than the other to elevate one end of said container, said container comprising:

a pan having a bottom, a first and second set of opposing sidewalls extending therefrom to an opening and defining a compartment for holding the food, and lips extending outwardly from said sidewalls of said first set for engaging the edges of the serving bar; and, a first cover engageable with the periphery of one end of said pan adjacent said opening for closing a portion of said opening adjacent the elevated end of said pan; said first cover comprising a body engageable with the periphery of one end of said pan, a flange extending generally perpendicularly from one end of said body and latchable with either one of said lips of said pan, and a ledge extending generally perpendicularly from the other end of said body in a direction opposite to that of said flange of said first cover.

2. A container as recited in claim 1, wherein: said sidewalls of said second set taper in height, between said bottom and said opening, to further define said compartment as having a first portion of larger volume at one end of said pan than a second portion having a smaller volume at the other end of said pan.

3. A container as recited in claim 1, wherein: said flange of said first cover latches onto the elevated end of said pan; whereby, said first cover is adaptable to support a decorative covering held in place by said ledge.

4. A container as recited in claim 1, further comprising: a second cover having the same structure as the first cover and engageable with the periphery of the other end of said pan adjacent said opening; and, wherein said ledges of said first and second covers are positioned over said lips of said pan, said flanges of said covers being contiguous with each other and extending into said compartment; whereby, the food in said container is completely covered and said covers form a substantially flat surface so that a similar container is stackable thereon.

5. A container as recited in claim 4, wherein: said bodies of said first and second covers have a recess portion which fit into said compartment contiguous with said first and second set of sidewalls of said pan adjacent said lips extending outwardly therefrom.

6. A serving bar for supporting containers of food, said serving bar comprising:

a base having a substantially rectangular shaped opening and a substantially rectangular shaped upper edge at the periphery of said opening, a first pair of opposing edges being spaced apart by a fixed base length; and, a second pair of opposing edges having one edge higher than the other so that one edge of each of said containers is elevated higher than the other end;

a plurality of containers each comprising a pan having a bottom, a first and second set of opposing sidewalls extending therefrom to an opening and defining a compartment for holding the food, lips extending outwardly from said sidewalls of said first set and engaging a second pair of opposing edges of said base, and said sidewalls of said second set being spaced apart by a distance defined as a pan-width; the sum of all said pan-widths being substantially equal to said fixed base length and said containers being contiguously seated in the opening of said base; and each of said containers further comprising a first cover engageable with the periphery of one end of said pan adjacent said opening for closing a portion of said opening adjacent the elevated end of said pan, said first cover of each container comprising a body engageable with the periphery of one end of said pan, a flange extending generally perpendicularly from one end of said body and latchable with either one of said lips of said pan, and a ledge extending generally perpendicularly from the other end of said body in a direction opposite to that of said flange of said first cover.

7. A serving bar as recited in claim 6, wherein: an integral width is defined as said fixed base length divided by a maximum number of said containers that can comprise said plurality; said plurality comprises an actual number of said containers less than or equal to said maximum number; and, said pan-width of each container is equal to an integral multiple of said integral width; whereby, containers of different widths may be contiguously seated in the opening of said base.

8. A serving bar as recited in claim 6, wherein: for each container, said sidewalls of said second set taper in height, between said bottom and said opening, to further define said compartment as having a first portion of larger volume at one end of said pan than a second portion having a smaller volume at the other end of said pan.

9. A serving bar as recited in claim 6, wherein: said flange of said first cover latches onto the elevated end of said pan; whereby, said first cover is adaptable to support a decorative covering held in place by said ledge.

10. A serving bar as recited in claim 6, further comprising: a second cover having the same structure as the first cover and engageable with the periphery of the other end of said pan adjacent said opening; and, wherein said ledges of said first and second covers are positioned over said lips of said pan, said flanges of said covers being contiguous with each other and extending into said compartment; whereby, the food in said container is completely covered and said covers form a substantially flat surface so that a similar container is stackable thereon.

11. A serving bar as recited in claim 10, wherein: said bodies of said first and second covers have a recess portion which fit into said compartment contiguous with said first and second set of sidewalls of said pan adjacent said lips extending outwardly therefrom.

* * * * *